US005135407A

United States Patent [19]

Berends

[11] Patent Number: 5,135,407

[45] Date of Patent: Aug. 4, 1992

[54] LAMP CONVERSION KIT

[75] Inventor: Boyd E. Berends, Holland, Mich.

[73] Assignee: Progressive Technology in Lighting, Inc., Holland, Mich.

[21] Appl. No.: 644,546

[22] Filed: Jan. 23, 1991

[51] Int. Cl.[5] ..... H01R 33/02

[52] U.S. Cl. ..... 439/236; 439/360; 439/502

[58] Field of Search ..... 439/226, 232, 233, 236, 439/360, 502, 505, 628, 638, 655; 313/318; 336/105, 107

[56] References Cited

U.S. PATENT DOCUMENTS

| | | | |
|---|---|---|---|
| 2,416,285 | 2/1947 | Buckingham et al. | 439/360 X |
| 2,976,524 | 3/1961 | Wall | 439/502 X |
| 3,120,419 | 2/1964 | Dworkin | 439/360 X |
| 3,660,797 | 5/1972 | Firestone | 439/502 |
| 3,711,806 | 1/1973 | Flentge | 336/107 X |
| 4,637,671 | 1/1987 | Johnson et al. | 439/359 X |
| 4,900,270 | 2/1990 | Edwards et al. | 439/502 |
| 4,936,789 | 6/1990 | Ugalde | 439/236 |

*Primary Examiner*—Larry I. Schwartz
*Assistant Examiner*—Khiem Nguyen
*Attorney, Agent, or Firm*—Price, Heneveld, Cooper, DeWitt & Litton

[57] ABSTRACT

A fluorescent trouble light conversion set includes a socket adaptor which receives a single-ended fluorescent lamp and screws into a standard screw socket. A wall adaptor which plugs into an AC wall outlet is provided to supply power for the fluorescent lamp. The wall adaptor includes a housing for a ballast and transformer, and a socket for receiving the plug from a lamp having the fluorescent lamp mounted therein to supply power for the bulb. The socket is connected to the housing by a cord.

18 Claims, 2 Drawing Sheets

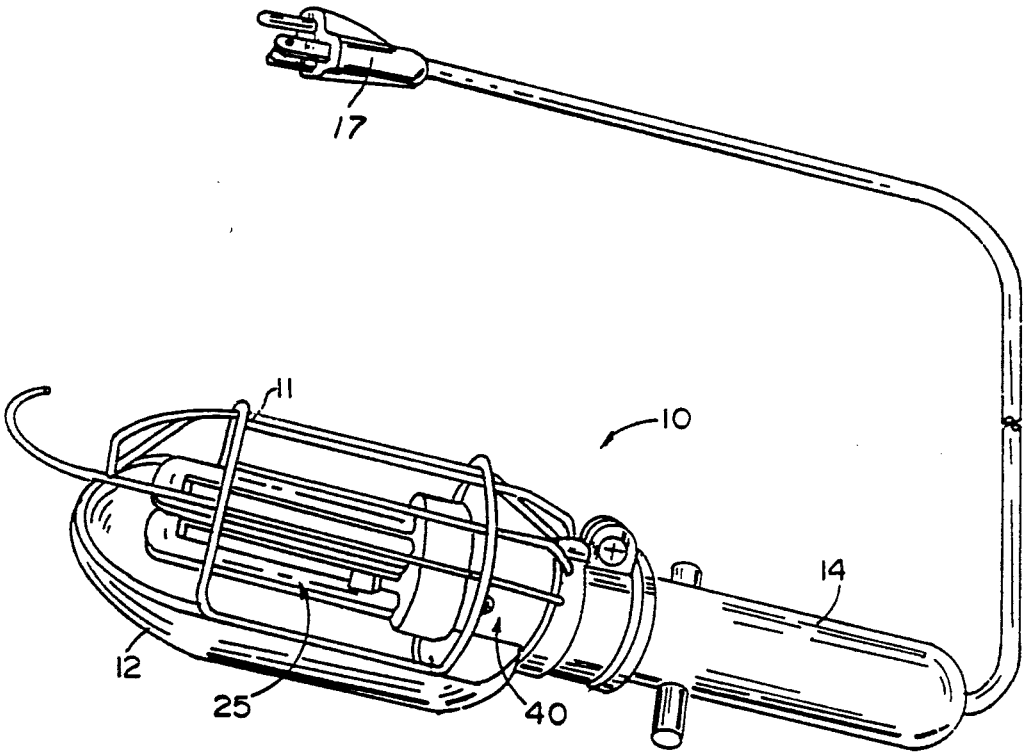
FIG. 1
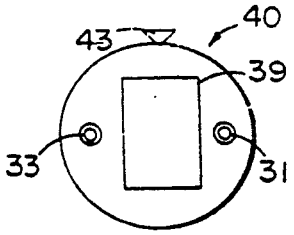
FIG. 4B
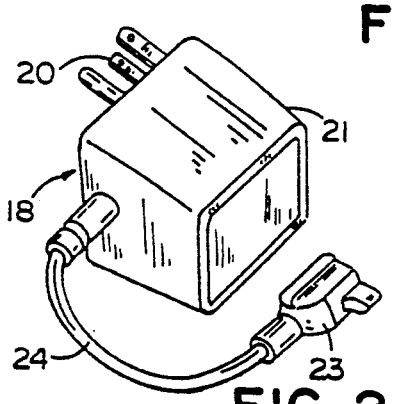
FIG. 2
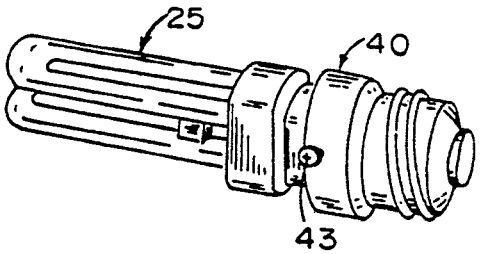
FIG. 5
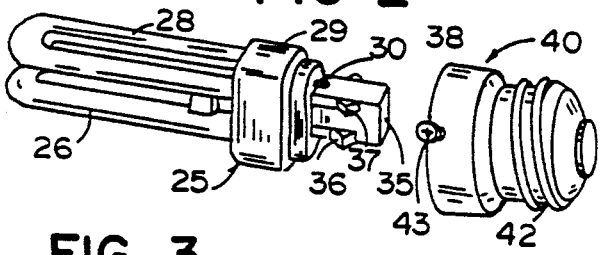
FIG. 3
FIG. 4A

LAMP CONVERSION KIT

BACKGROUND OF THE INVENTION

The present invention pertains to compact fluorescent lights and in particular to a conversion kit by which a single ended fluorescent lamp may be provided for a lamp holder having a standard screw socket.

It is known to provide a single-ended fluorescent lamp with an adaptor for a standard screw socket of a lamp holder. The adaptor provides the power conversion for the fluorescent lamp and screws into a standard screw socket and includes a ballast and power converter for generating the appropriate power supply from an AC outlet to supply the fluorescent lamp, and consequently, is large and heavy. These known adaptors may not be used with lamp holders which do not have space for both the bulb and the large adaptor between the screw socket and the structure which surrounds the socket. Additionally, the heavy weight of known adaptors renders small lamps top heavy, and causes them to fall over easily.

One fluorescent lamp conversion kit is illustrated in U.S. Pat. No. 4,936,789. This kit includes a housing containing power conversion circuitry, and an adaptor for receiving a single ended fluorescent lamp, the adaptor including a threaded end for insertion into a standard screw socket. Because the power conversion circuitry which provides energizing and starting power for the fluorescent lamp is carried within the housing, the adaptor is relatively light weight and small in size. However, the housing has a receptacle on an exterior surface thereof which includes apertures in the housing surface for receiving plug prongs. The apertures in the housing surface allow access by insects, liquid, and debris, and thus is not well suited for outside use. Furthermore, the plug received within the socket may be easily removed, causing the circuit connection between the adapter and the lamp to be interrupted. This is especially a problem for "trouble" lights which are moved often to illuminate different working positions.

Trouble lights typically include a cage which surrounds an incandescent light bulb which is received within a screw socket therein. The use of incandescent light bulbs in trouble lights has several disadvantages. The filaments provided in incandescent light bulbs brake easily, and consequently movement of the trouble light may cause the filament to brake. Additionally, incandescent bulbs operate at high temperatures which may cause accidental burning of a user's hands and arms. Incandescent bulbs are also adversely effected by cold air, water, oil, or solvents which may come into contact with the bulbs when they are hot, and consequently cause the light bulbs to explode.

SUMMARY OF THE INVENTION

The present invention is embodied in a system having a socket adaptor receiving a single-ended fluorescent lamp, and a housing enclosing power conversion circuitry which provides energizing power to a fluorescent lamp attached thereto. More particularly, in a device embodying the invention, the housing includes a receptacle which is connected to the housing by a cord having a length of at least six inches.

The housing thus allows a trouble light cord to be attached to the wall plug adapter such that the respective cords may be tied together to prevent separation of the plug and the socket. Accordingly, when the trouble light is moved around by a user, the electrical connection between the trouble light and power conversion adapter is secure. Further, by providing the socket remote from the housing, the housing does not include plug receiving apertures located on the surface thereof and thus avoids entry of water to the circuitry when used in a damp environment. Furthermore, the six inch cord allows the kit to pass UL (Underwriter's Laboratories) requirements. These and other objects, advantages and features of the invention will become apparent upon review of the following specification in conjunction with the drawings.

BRIEF DESCRIPTION OF THE DRAWINGS

FIG. 1 illustrates a trouble light having a fluorescent lamp according to the invention attached thereto.

FIG. 2 illustrates a wall plug adaptor according to the invention;

FIG. 3 illustrates a fluorescent lamp utilized by the invention;

FIGS. 4*a* and 4*b* illustrate a socket adaptor for us in the present invention;

FIG. 5 illustrates the fluorescent lamp of FIG. 2 received in the socket adaptor of FIG. 4*a* and 4*b;*

DETAILED DESCRIPTION OF THE PREFERRED EMBODIMENTS

Figure 6:
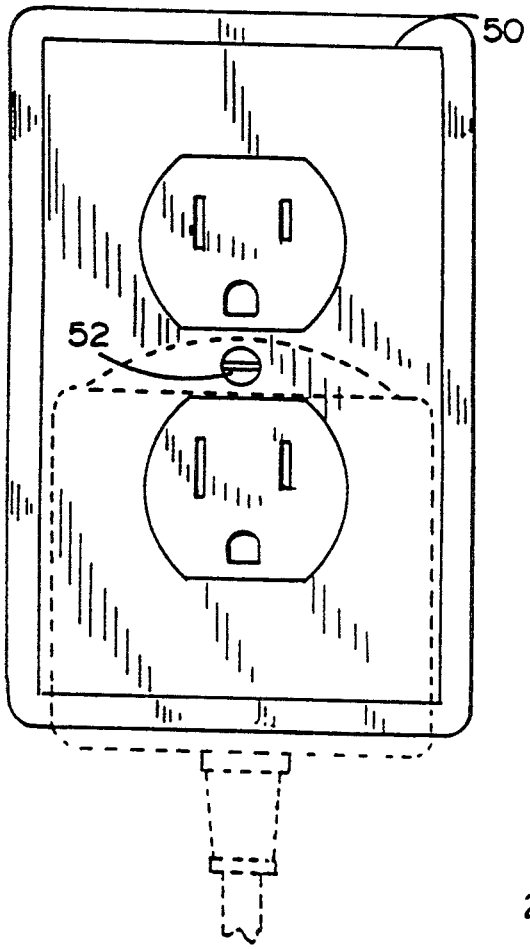
FIG. 6 illustrates a wall outlet and the position of a wall plug adapter received thereon.

Referring now specifically to the drawings and the illustrated embodiments depicted therein, a particularly advantageous application of the inventive concept is a trouble light 10 which includes a cage comprising a front cover 11 and a back shield 12. Such trouble lights are inexpensive and readily available. Furthermore, many consumers already own a trouble light and can, therefore, utilize the present invention to obtain the numerous benefits of compact fluorescent lamp technology without a large investment. A fluorescent lamp 25 and a socket adaptor 40 are provided within trouble light cage 11 and received in a standard screw socket (not shown) in handle 14. A cord 15 comprising standard 120 volt wiring connects handle 14 with three-prong plug 17.

A wall plug adaptor 18 (FIG. 2) includes a three prong plug 20, a housing 21, a three prong receptacle 23, and a cord 24 comprising standard 120 volt wiring connecting the circuitry within housing 21 to the socket 23. Housing 21 contains a ballast for supplying appropriate strike voltages and operating voltages for lamp 25. Such ballast may include an electronic ballast or a conventional core and coil transformer, and a magnetic ballast, which are not shown. The circuitry in housing 21 has a normal power factor for providing power to a fluorescent lamp, and thus provides 57 volts AC and up to 280 milliamps of current for operating the fluorescent lamp 20 (FIG. 2). Additionally, a current of 520 milliamps will be provided initially by the circuitry in housing 21 to start the fluorescent lamp. The circuit components in housing 21 are readily available standard components which are well known in the art, and accordingly will not be described in greater detail herein.

Figure 7:
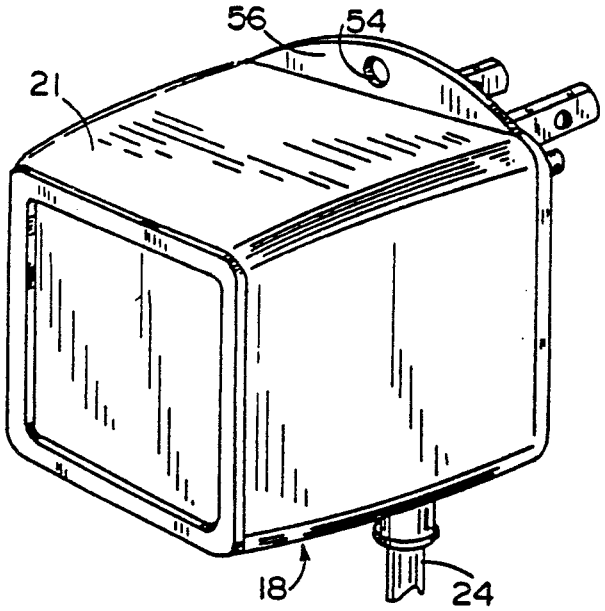
FIG. 7 illustrates a wall plug adapter having a flange according to one aspect of the invention.

Cord 24 is preferably at least six inches long, and may advantageously be provided having even larger lengths. By providing socket 23 on an end of cord 24, housing 21 does not have an aperture located therein, and thus, the housing surface does not include apertures for receiving the connectors of plug 17. This allows housing 21 to fully enclose the circuitry located therein in a simple and relatively inexpensive manner, and permits wall plug adaptor 18 to be used outdoors. Further, cords 24 and 15 (FIG. 1) may be used to secure the electrical connection between trouble light 10 and adapter 18. This may be done by simply tying the cords together, or by utilizing various well known attachments (not shown) for plugs and sockets such as 17 and 23, which will maintain the electrical connection therebetween. By securely mounting housing 21 to the wall outlet 50 (FIG. 6), using a screw 52 extending through a hole 54 (FIG. 7) in a flange 56 on housing 21 and received in the outlet cover screw threads, such arrangement avoids circuit interruption from inadvertent tugs on cord 15. Additionally, the cord 24 (FIG. 2) insures that the socket 23 is spaced at least six inches from circuitry within housing 18. This is important for UL approval as UL will only pass electrical devices having a six inch lead connecting a ballast to other circuitry.

The fluorescent lamp 25 (FIG. 3) has a first tube 26 and a second tube 28 carried by a base 29. A first electrical conductor 30 projects from base 29 and makes electrical contact with connector 31 (FIG. 4*b*) on socket adaptor 35. A similar electrical conductor (not shown) projects from the side of base 29 opposite conductor 30 and is received by an electrical connector 33 on socket adaptor 40. Base 29 includes a projection 35 having four frictional elements 36, 37 and 38 (the fourth frictional element not shown) thereon which provide frictional coupling between base 29 and the adaptor 40 (FIGS. 4*a* and 4*b*) when projection 35 is received within a receptacle 39 of socket adaptor 40. Socket adaptor 40 (FIG. 4*a*) includes threads 42 which are used to screw the socket adaptor into a standard lamp screw socket. A screw 43 is provided to secure the fluorescent lamp within socket adaptor 40. Fluorescent lamp 25 is a double duplex twin tube fluorescent lam which is basically of a conventional design. In the illustrated embodiment, lamp 25 is a 13 watt compact fluorescent lamp marketed by Osram under model number F13DTT/27K. The fluorescent tubes may advantageously be covered with a silicon coating which prevents the glass of the tubes from shattering if the tubes are broken. Such silicone coatings are known in the art and used on light bulbs which are mounted over counter tops or meat counters where it is likely that someone may come into physical contact with the light bulbs causing them to break, and in locations where broken glass would be especially dangerous.

Upon assembly fluorescent lamp 25 is received in socket adaptor 40 as shown in FIG. 5 and screw 43 is screwed into projection 3 (FIG. 3) to prevent fluorescent lamp 25 from separating from socket adaptor 40. The bulb and adaptor are then inserted into trouble lamp 10. When lamp plug 17 is plugged into output socket 23, the voltage output from housing 21 will provide power which is compatible with fluorescent lamp 25 received in socket adaptor 40 and screwed into trouble lamp 10. If a user inadvertently plugs the trouble light into a wall outlet without using the converter 18, the fluorescent lamp may cease to operate, but should not explode.

Although the invention has been advantageously exemplified with a trouble light, the invention is also useful for indoor lamps such as indoor use in bedrooms and living rooms as well as offices. Thus, changes and modifications in the specifically disclosed embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A lamp assembly comprising: a trouble light having a single-ended fluorescent lamp in a standard screw socket, a cage enclosing the single-ended fluorescent lamp, a handle carrying the cage and the screw socket, a cord connected to the screw socket and a plug carried on the cord, a socket adaptor, said fluorescent lamp carried in said socket adaptor and said socket adaptor carried in said screw socket; and a wall adaptor unit including a housing, a ballast unit contained in said housing and a wall adaptor socket, said housing adapted to be attached to a wall outlet, said ballast unit adapted to supply power which will illuminate said fluorescent lamp when said wall adaptor is connected to receive power from an AC wall outlet, whereby said fluorescent lamp will operate when said plug is connected to said wall adaptor socket to receive power from said ballast unit, said wall plug adaptor further including a cord extending from said housing by which said wall adaptor socket is connected to said housing whereby said wall adaptor socket is remote from said housing.

2. The lamp assembly as defined in claim 1, wherein said fluorescent lamp includes a silicon coating to prevent shattering thereof.

3. The lamp assembly as defined in claim 1, wherein said socket adaptor includes a screw for securing said fluorescent lamp in said socket adaptor when said lamp is frictionally received within said socket adaptor.

4. The lamp assembly as defined in claim 1 wherein said wall plug adaptor cord is at least six inches long.

5. The lamp assembly as defined in claim 4, wherein said fluorescent lamp includes a silicon coating to prevent shattering thereof.

6. The lamp assembly as defined in claim 5, wherein said socket adaptor includes a screw for securing said fluorescent lamp in said socket adaptor when said lamp is frictionally received within said socket adaptor.

7. The lamp assembly as defined in claim 1, wherein said housing includes projection with an aperture to receive a screw, whereby said housing may be secured to an AC wall outlet by a screw for securing an AC wall outlet cover plate to said AC wall outlet.

8. The lamp assembly as defined in claim 1, wherein said fluorescent lamp includes a base and elements which project outwardly from sides of said base to frictionally engage interior sides of a recess in said socket adaptor.

9. The lamp assembly as defined in claim 3, wherein said fluorescent lamp includes a base and elements which project outwardly from sides of said base to frictionally engage interior sides of a recess in said socket adaptor.

10. A lamp assembly comprising; a trouble light having a single ended fluorescent lamp mounted in lamp holder in the trouble light, a cage adapted to enclose the fluorescent lamp, a handle carrying the cage, a cord extending from the handle and a plug connected to the cord; and an adaptor including an adaptor housing and circuitry including a power converter provided in said housing, a plug adapted to plug into a standard AC wall outlet and a receptable adapted to receive a plug from the trouble light, said power converter including a ballast for supplying power compatible with said fluorescent lamp whereby said trouble light plug is plugged into said receptable to receive power for illuminating said fluorescent lamp, said receptacle connected to circuitry within said housing by an adaptor cord whereby said receptable is remote from said housing and said receptable is connected to said circuitry within said housing such that the receptable will not be disconnected from the circuitry when a force is exerted on said receptable.

11. The lamp assembly as defined in claims 10 wherein said lamp holder includes a said standard screw socket and a screw socket adaptor for receiving said single-ended fluorescent lamp and screwing into said standard screw socket.

12. The lamp assembly as defined in claim 11, wherein said fluorescent lamp includes a silicon coating to prevent shattering thereof.

13. The lamp assembly as defined in claim 12, wherein said socket adaptor includes a screw for securing said fluorescent lamp when it is frictionally received within said screw socket adaptor.

14. The lamp assembly as defined in claim 13, wherein said adaptor cord is at least six inches long, and comprises 120 volt wiring.

15. The lamp assembly as defined in claim 10, wherein said housing includes a projection with an aperture to receive a screw, whereby said housing may be secured to an AC wall outlet by a screw for securing an AC wall outlet cover plate to said wall outlet whereby when a force is exerted on said cord, said socket will remain electrically connected to said AC wall outlet.

16. The lamp assembly as defined in claim 10, further including a screw socket adaptor for receiving said fluorescent lamp, said fluorescent lamp including a base and elements which project outwardly from sides of said base to frictionally engage interior sides of a recess in said socket adaptor.

17. The lamp assembly as defined in claim 13, wherein said fluorescent lamp includes a base and elements which project outwardly from sides of said base to frictionally engage interior sides of a recess in said socket adaptor.

18. A trouble light assembly, comprising:

a single-ended fluorescent lamp;

a standard screw socket;

a trouble light cage adapted to enclose the fluorescent lamp;

a handle carrying the cage and the screw socket;

a plug coupled to said screw socket by a cord;

a socket adaptor, said fluorescent lamp carried on said socket adaptor and said socket adaptor carried in said screw socket; and a wall adaptor including a housing, a ballast unit contained in said housing and a wall adaptor socket, said housing adapted to be attached to a wall outlet, said ballast unit adapted to supply power which will illuminate said fluorescent lamp whereby said fluorescent lamp operates when said trouble light plug is plugged into said wall adaptor socket and said wall adaptor is connected to a wall outlet to receive power from said wall outlet, said wall adaptor further including a cord extending from said housing by which said wall adaptor socket is connected to said housing whereby said wall plug adaptor socket is remote from said housing.

* * * * *